US005662239A

United States Patent [19]

Heuvelman

[11] Patent Number: 5,662,239

[45] Date of Patent: Sep. 2, 1997

[54] MEDICINAL CONTAINER WITH COMPLETE INSTRUCTIONS

[76] Inventor: George M. Heuvelman, P.O. Box 544, Burlington, Ill. 60109

[21] Appl. No.: 730,713

[22] Filed: Oct. 15, 1996

[51] Int. Cl.[6] ..... B65D 51/24

[52] U.S. Cl. ..... 220/506

[58] Field of Search ..... 220/506, 23.83; 206/222; 215/206, 230, 224

[56] References Cited

U.S. PATENT DOCUMENTS

| | | | |
|---|---|---|---|
| 1,619,727 | 3/1927 | Hill . | |
| 2,844,893 | 7/1958 | Keller . | |
| 2,941,689 | 6/1960 | Black . | |
| 3,256,978 | 6/1966 | Srigley et al. . | |
| 3,459,295 | 8/1969 | Cousar | 220/506 |
| 4,054,208 | 10/1977 | Lowe . | |
| 4,204,597 | 5/1980 | Fischer | 220/506 |
| 4,410,085 | 10/1983 | Beneziat et al. | 220/506 |
| 4,526,293 | 7/1985 | Kramer . | |
| 4,583,667 | 4/1986 | Fishman et al. . | |
| 4,627,595 | 12/1986 | Rhodes et al. | 220/506 |
| 4,762,224 | 8/1988 | Hall | 220/506 |
| 4,782,963 | 11/1988 | Hunter . | |
| 4,979,325 | 12/1990 | White . | |
| 4,991,729 | 2/1991 | Hunter . | |
| 5,011,032 | 4/1991 | Rollman . | |
| 5,119,560 | 6/1992 | Noble . | |
| 5,209,348 | 5/1993 | Schafer, II | 220/506 |
| 5,465,556 | 11/1995 | Wooldridge et al. . | |
| 5,477,981 | 12/1995 | Heyl et al. . | |

*Primary Examiner*—Joseph M. Moy
*Attorney, Agent, or Firm*—Mathew R. P. Perrone, Jr.

[57] ABSTRACT

A compartmented container with an outer container substantially concentric with an inner container has usable contents, such as a medicine, placed within the inner container and information about the contents placed between the inner container and the outer container.

20 Claims, 4 Drawing Sheets

MEDICINAL CONTAINER WITH COMPLETE INSTRUCTIONS

This invention relates to a container for medicine and more particularly to a compartmented, medicinal container for which includes a substantially complete description of the medicine removably secured within the container.

BACKGROUND OF THE INVENTION

A small bottle (usually a container and preferably a cylindrical container) is used for the containment and delivery of medicine; such as prescriptions, vitamins, medications, pills, capsules, liquids and similar items. The consumer then uses the bottle as storage place for the medicine enclosed therein, while consuming the contents thereof in the required fashion. It is customary for a bottle or other container holding such an item to have a description of its contents on the exterior thereof. That description is usually taped, glued or otherwise secured to the outer surface.

The bottles are typically used to house and secure medications, vitamins, and sometimes volatile chemicals for nearly all industries. Such a bottle or container is especially useful for medicines. The outer surface of the bottle is limited by its size as to the amount of information that can be provided thereon, about the medicine contained therein.

A general structure of the bottle can be found in U.S. Pat. No. 4,045,208 to Fred H. Lowe. Many other bottles are also known. These patents are incorporated herein by reference.

The bottle is typically a single walled hollow cylinder. A solid bottom closes one end of the bottle, thereby usually forming a closed end hollow cylinder; although other shapes are possible. The solid bottom is usually perpendicular to the cylinder and spans the entire area across the bottom of the cylinder, and thus enclosing one end of the cylinder.

The top of the bottle is removably closable. However, it can typically be closed with a removable cap 6r cover, which when attached encloses the cylinder at the end opposite to the solid bottom of the cylinder. It is customary for the cap or cover to attach to the cylinder in a secure manner such that the intended user can remove and re-attach it as required.

The bottle is used to house, contain, or deliver specific contents to its intended user in as secure a manner as possible. Basic information is printed on the outer surface of the bottle. Such verbiage relates to the contents and recommended usage instructions for the intended user of the contents.

The quantity of information and instructions available with current bottles and containers is limited by the size of the bottle's exterior surface, and therefore may be unable to provide as much adequate information as is needed by the user. This is especially true in the case of drugs, whether in liquid or pill or capsule form.

What is desired is a bottle, which can provide additional information can be provided while still maintaining, for the intended user, delivery and containment elements of the bottle, for which it was originally intended. Clearly additional information relating to the complexities of the drug, includes, but is not limited to, interaction with other drugs and side effects of the current drug.

This additional information almost inherently contains too many words to fit on the bottle label. As a result, now the customary practice is to staple the list or instructions to a bag containing the drug bottle. The consumer, at home, tends to dispose of everything but the pill bottle, thereby losing the advantage of these important instructions. Some simplified device for holding this information at or near the drug bottle is clearly required. There is no known simplified system for keeping these instructions at hand.

SUMMARY OF THE INVENTION

Therefore, among the many objectives of this invention is to provide a container for medicine, which also stores substantially complete information about the medicine with the container.

A further objective of this invention is to provide a container capable of holding substantially complete information about the contents thereof.

A still further objective of this invention is to provide a container, with access to substantially complete information about the contents thereof.

Yet a further objective of this invention is to provide a container capable of dispensing the medicine efficiently.

Also an objective of this invention is to provide a container capable of receiving substantially complete information about the contents thereof.

Another objective of this invention is to provide a container capable of removably receiving substantially complete information about the contents thereof.

Yet another objective of this invention is to provide a container capable of easily removing substantially complete information about the contents thereof.

Still another objective of this invention is to provide a container capable of protecting substantially complete information about the contents thereof.

These and other objectives of the invention (which other objectives become clear by consideration of the specification, claims and drawings as a whole) are met by providing a compartmented container with an outer container substantially concentric with an inner container, where a medicine or other usable contents may be placed within a compartment in the inner container, and instructions or information thereon can be placed in compartment formed between the inner container and the outer container. In this fashion, the instructions or information remain in close proximity to the usable contents.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
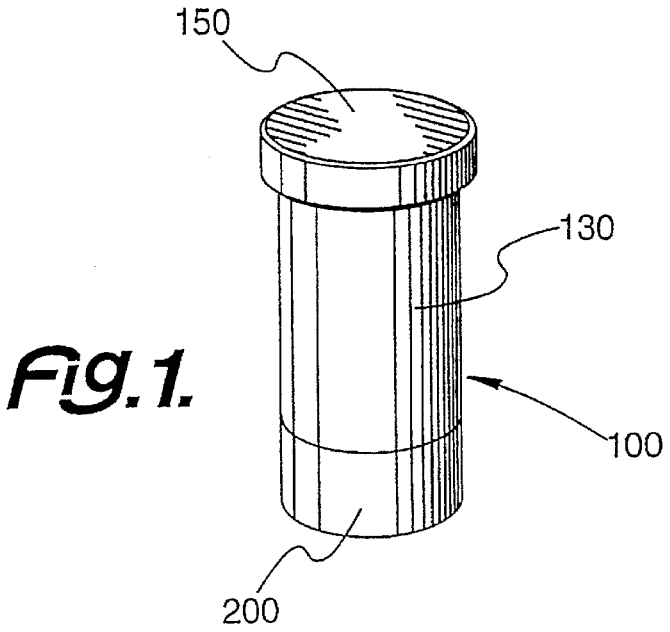
FIG. 1 depicts a perspective view of the medicinal container 100 of this invention.

In order to hold the instructions directly with the pills or medicine or other contents, the compartmented container of this invention has are two concentric containers. The inner container is mounted within the outer container. The inner container receives the pills or other usable item in one compartment. Within a receiving space or compartment created between the concentrically mounted outer container and inner container, the extensive instructions may be received. The extensive instructions thus remain in close proximity to the medicine or other usable contents.

As such, there is a first opening at a first end of the concentric containers through which the pills may be inserted into the inner container. Preferably no access is permitted to the interior portion of the outer container through the first opening, because of the spacer.

There is also a second opening at the opposing end of the concentric containers, through which the instructions may be inserted into the receiving space or compartment. Preferably no access is permitted to the interior of the inner container through the second opening. Because the two containers are spaced apart, thereby creating the receiving space or compartment, the instructions may be contained therebetween.

Within the pill container, the inner container preferably extends beyond the outer container. The extension simplifies the insertion of instructions between the inner container and the outer container by assisting the insertion of the sheet between the two containers.

Bottom cover closes the second opening thereby closing the outer container and substantially, completely encasing the inner container. Bottom cover can extend as a cylinder closed on one end. Bottom cover thus combines with outer container to secure the medicinal container.

More preferably, on one side of the extension, is a slot for receiving the instructions and permitting rolling of the instructions to fit in the sleeve between the outer container and the inner container. On the other side is a notch to permit easy gripping of the instructions and removing them from the bottle in order to read them.

The slot extends from the bottom edge of the inner container into an extended side of the inner container. The width of the slot is sufficient to receive a thickness of paper. It is long enough to hold the thickness so that the paper may be wrapped around the base of the inner container. After the wrapping is complete, the paper with the information thereon may be slipped out of the slot and slid between the inner container and the outer container. By then adding the bottom cap the paper is contained in the medicinal container.

The notch is also situated in the bottom edge of the inner container and preferably arcuate in shape. This notch permits an easy grip for removing the instructions from the medicinal container. Preferably, the notch and the slot are diametrically opposed for manufacturing purposes. Other positions are, however, suitable locations if desired.

The instruction end of the container is closed by a screw on base, snap on case, or other suitable attachment device. This device for attaching the base may or may not be childproof. It is not required to be childproof, because no access to the drugs is provided thereby.

Bottom cover and top cover may be secured to the medicinal container in any suitable manner. The same or a different fastening mechanism for bottom cover and top cover may be used on the same medicinal container.

Because the top cover provides access to the medicine, a child proof closure may be required. Typical of the standard child proof closures known in the art are the alignment type, and the press and twist or bayonet type. With the alignment type, a marker on the container and a marker on the cap must be aligned for opening.

The press and twist type, that is bayonet type, requires pressure on the cap exerted toward the bottle before twisting to remove the cap. This type may also require pressing a tab on the cap to get by a protrusion on the bottle for opening.

The spacer for holding the drug container (that is the inner container) away from the outer container may be stepped or angled. If it is stepped, the steps make it easier to extract or otherwise remove just one pill from the container. While it is not desired to be bound, by any particular theory, it is believed that the steps create an edge friction, which facilitates the dispensing of the pills one at a time.

Any acceptable method may be used for forming the inner container and the outer container. A preferred method is having the spacer act is a separate piece and be glued or otherwise secured between inner container and outer container. It is also possible to mold inner container and outer container and spacer as one piece.

Of course, the opening provided to the medicine can be protected by a childproof container. This feature is adapted for liquid and pill type materials. The liquid may in and of itself be contained in the inner material provided the container is liquid resistant. The container may also hold a non childproof bottle and provide the liquid therein.

Referring now to FIG. 1, the medicinal container 100 of this invention has a top cover 150 oppositely disposed from the bottom cover 200 mounted on the outer container 130 thereof. In a preferred form removal of top cover 150 provides access to medicine. Top cover 150 may therefore be fastened with that generic of fasteners commonly known as childproof, provided that the medicine can possibly become accessible to a child. In the case of minimized access of the medicine by a child or a handicap, a child proof fastener is not used. s directly with the pills or medicine the medicinal container of this invention, there are two concentric containers.

Bottom cover 200 may also be fastened to outer container 130 of medicinal container 100 in any suitable fashion. Because no access to medicine is provided therethrough, the childproof variety of attachment is not usually required for bottom cover 200.

Figure 2:
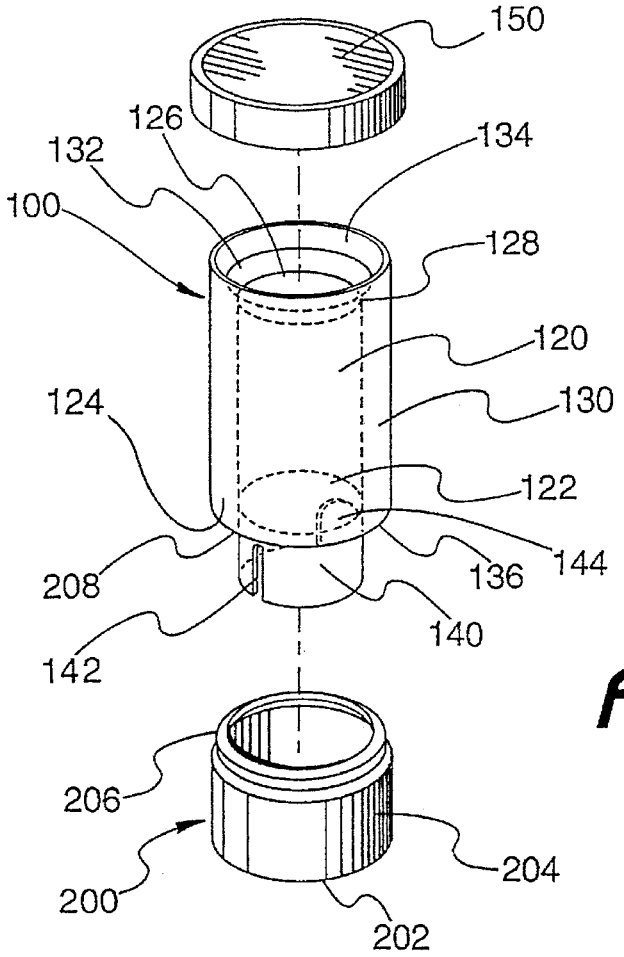
FIG. 2 depicts an exploded, perspective view of the medicinal container 100.

With consideration of FIG. 2, then inner container 120 is mounted within the outer container 130 to form the medicinal container 100 of this invention. The inner container 120 receives the pills (not shown). A spacer 132 is secured on an exterior 128 of inner container 120 and on an interior 134. Thus inner container 120 is interior to and substantially concentric with outer container 130

Spacer 132 creates a receiving space 124 between the concentrically mounted outer container 130 and inner container 120 into which, instructions 110 may be received. Clearly, inner container 120 has a diameter less than outer container 130. Thus is created an efficient manner of keeping such instructions 110 with the medicine (not shown).

As such, there is a first opening 126 at a first end of the medicinal container 100 through which the pills may be inserted into the inner container 120. Preferably no access is permitted to the outer container 130 through the first opening 126.

There is also a second opening 136 at the opposing end of the medicinal container 100, through which instructions 110 may be inserted. Preferably no access is permitted to the interior of the inner container through the second opening 136. Because the inner container 120 and the outer container 130 are spaced apart, thereby creating the receiving space 124, the instructions 110 may be contained therebetween.

Figure 3:
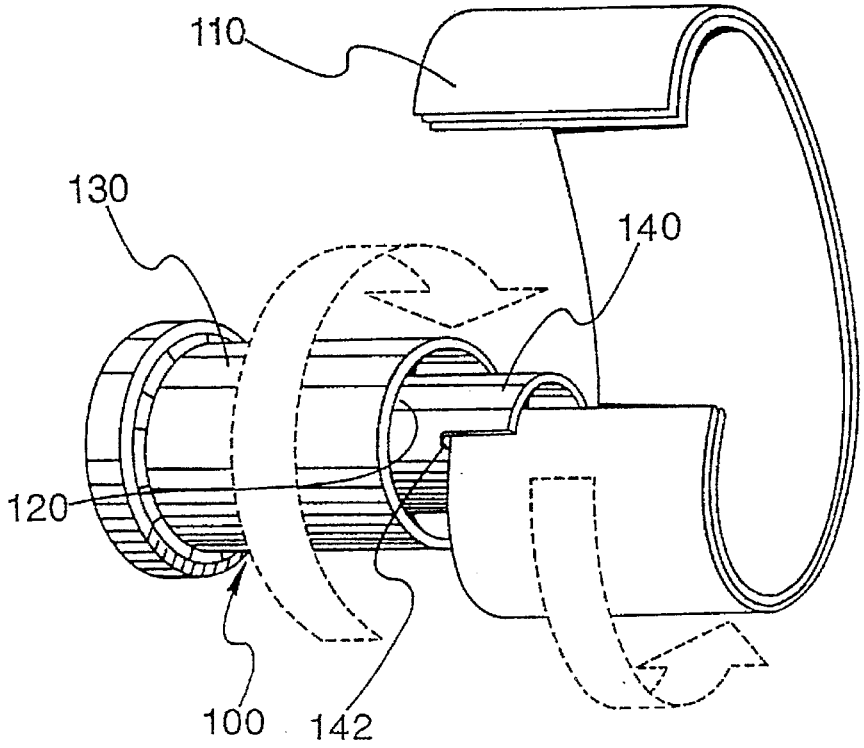
FIG. 3 depicts an exploded view showing a method of inserting instructions 110 between inner container 120 and outer container 130 of the medicinal container 100 of this invention.

Adding FIG. 3 to the consideration, the medicinal container 100 preferably has the inner container 120 extending beyond the outer container 130 at bottom cap. The extension 140 simplifies the insertion of instructions 110 between the inner container 120 and the outer container 130 by assisting the insertion of the sheet or sheets of instructions 110 therebetween.

Bottom cover 200 closes the second opening 136 thereby closing the outer container 130 and substantially, completely encasing the inner container 120. Top cover 150 closes both outer container 130 and inner container 120 adjacent to spacer 132. Spacer 132 also preferably closes that end outer container 130.

Inner container 120 has a sealed base 122 adjacent to extension 140. Thus top cover 150 secures medicine in inner container 120, in combination with sealed base 122.

Bottom cover 200 can extend as a cylinder closed on one end. Bottom cover 200 thus combines with outer container 130 to secure the medicinal container 100. Bottom cover 200 has a bottom base 202. Extending upwardly from bottom base 202 is cylinder side 204. Cylinder side 204 is of sufficient length to receive extension 140 therein and join with outer container 130.

If extension 140 is not desired, bottom cover 200 can be similar to top cover 150. That bottom cover 200 will not require cylinder side 204. Whether cylinder side 204 is present or not, top cover 150 and bottom cover 200 may have the different mechanism for securing the same to outer container 130, depending all circumstances involved.

Oppositely disposed from bottom base 202 on cylinder side 204 is male snap member 206. Male snap member 206 is received by female snap member 208 on outer container 130. This combination of male snap member 206 and female snap member 208 secures bottom cover 200 to outer container 130 and secures instructions 110 within receiving space 124.

More preferably, on one side of the extension 140, is a* slot 142 for receiving the instructions 110 and permitting rolling of the instructions 110 to fit in the sleeve or receiving space 124 between the outer container 130 and the inner container 120. On the other side of extension 140 and oppositely disposed from slot 142 is a notch 144 to permit easy gripping of the instructions 110 and removing them from the form the medicinal container 100 in order to read them.

Figure 4:
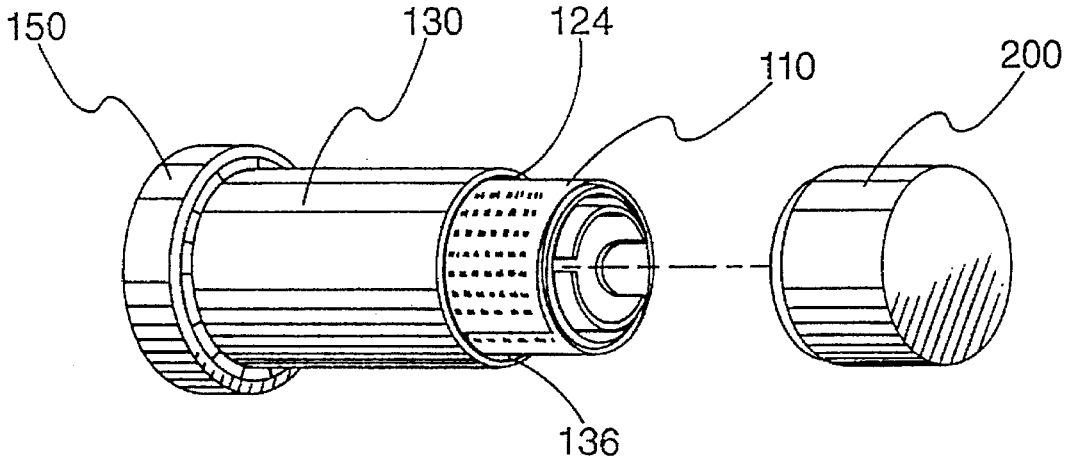
FIG. 4 depicts a view showing instructions 110 inserted between inner container 120 and outer container 130 of the medicinal container 100 of this invention.

In FIG. 3, slot 142 is depicted as narrow and elongated. Thus, slot 142 can receive the sheet or sheets on which instructions 110 are printed. The sheet of instructions 110 is then wrapped around extension 140 until an appropriate dimension is achieved so that instructions 110 may be slipped into receiving space 124, as shown in FIG. 4.

Figure 5:
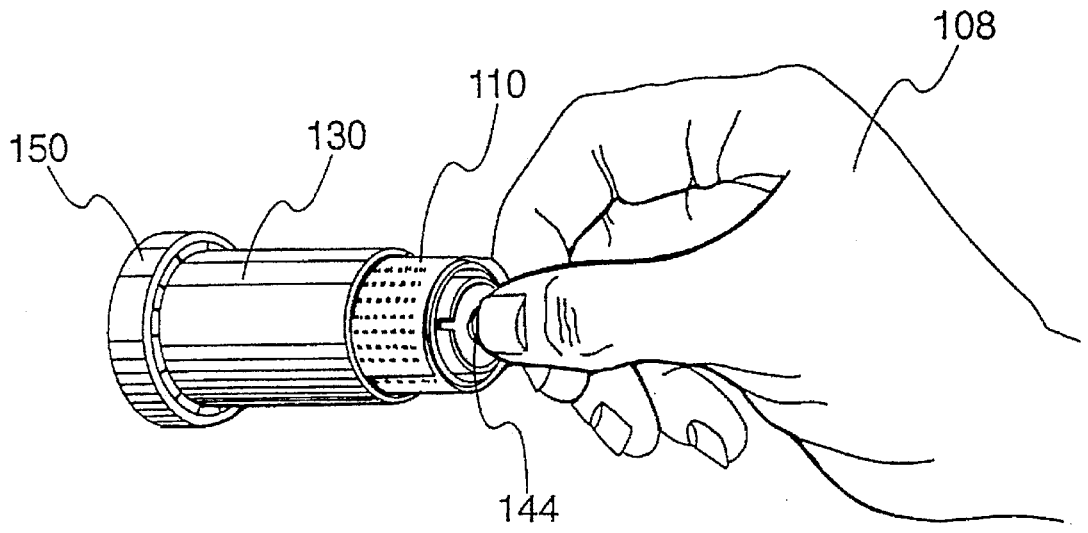
FIG. 5 depicts a partially exploded view showing instructions 110 being removed from the medicinal container 100 of this invention.

In FIG. 5, notch 144 is depicted as arcuate. Thus, hand 108 can grip instructions 110 are printed. The sheet of instructions 110 are then removed for reading. Intrusions 110 may be slipped back into receiving space 124, as shown in Figure and FIG. 4.

Figure 6:
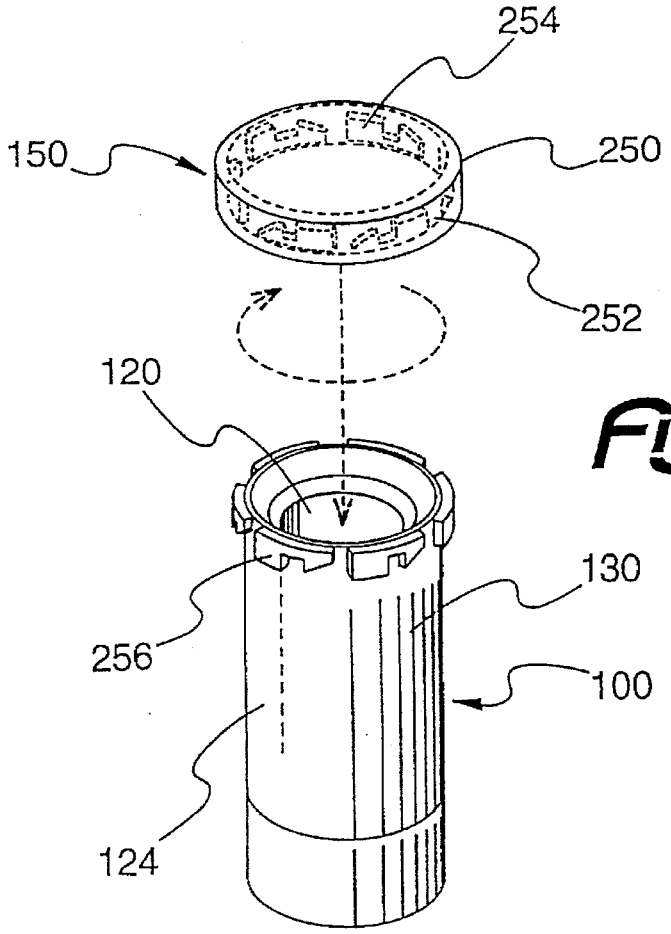
FIG. 6 depicts a perspective view of the medicinal container 100 of this invention in showing a bayonet style, childproof cap 250 for top cover 150.

In FIG. 6 top cover 150 for the medicinal container 100 may have bayonet style, childproof cap 250. Bayonet style, childproof cap 250 has a flexible insert 252 therein with female mating elements 254 to receive male mating elements 256. Male mating elements 256 are on an exterior of outer container 130 adjacent to spacer 124. Bayonet style, childproof cap 250 requires a downward press and twist to achieve access to inner container 120 and the medicine therein.

FIG. 7, FIG. 8, FIG. 9 and FIG. 10 combine to show various appropriate mechanisms for attaching either the top cover 150 or the bottom cover 200 of the medicinal container 100 of this invention. These mechanisms may be childproof if desired, or not childproof if not required. For convenience, bottom cover 200 is described.

Figure 7:
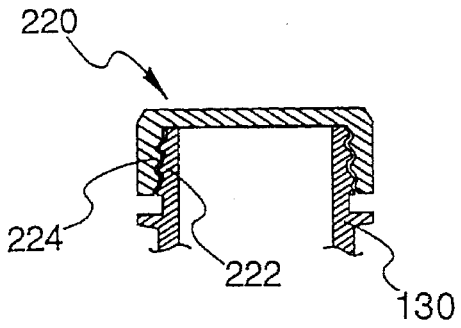
FIG. 7 depicts a side plan cross-sectional view of threaded mechanism 220 for either the top cover 150 or the bottom cover 200 of the medicinal container 100 of this invention.

In FIG. 7, a standard threaded mechanism 220 for the bottom cover 200 of the medicinal container 100 of this invention is shown. Threaded mechanism 220 includes male threads 222 in contact with female threads 224. Female threads 224 are situated on an interior of cylinder side 204 above bottom base 202. Male threads 222 are situated on the exterior of outer container 130 and are oppositely disposed from spacer 132. Clearly male threads 222 fit into female threads 224 and hold bottom cover 200 in position. Clearly, threaded mechanism 220 applies to top cover 150 also.

Figure 8:
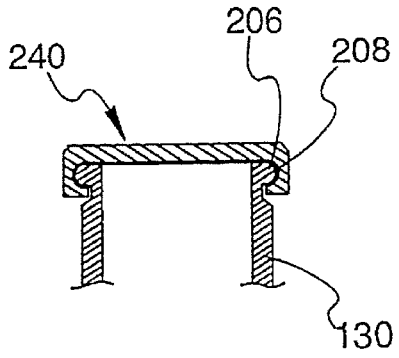
FIG. 8 depicts a side plan cross-sectional view of snap mechanism 240 for either the top cover 150 or the bottom cover 200 of the medicinal container 100 of this invention.

In FIG. 8, a standard snap mechanism 240 for the bottom cover 200 of the medicinal container 100 of this invention is shown. Snap mechanism 240 includes male snap member 242 in contact with female snap member 244. Female snap member 244 is situated on an interior of cylinder side 204 above bottom base 202. Male snap member 242 is situated on the exterior of outer container 130 and is oppositely disposed from spacer 132 (FIG. 1). Clearly male snap member 242 fits into female snap member 244 and holds bottom cover 200 in position. Snap mechanism 240 is not necessarily child proof. Clearly, snap mechanism 240 applies to top cover 150 also.

Figure 9:
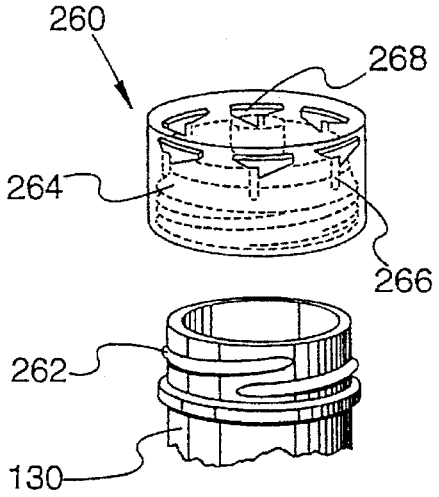
FIG. 9 depicts a side plan cross-sectional view of safety threaded child proof mechanism 260 for either the top cover 150 or the bottom cover 200 of the medicinal container 100 of this invention.

In FIG. 9, a standard safety threaded child proof mechanism 260 for the bottom cover 200 of the medicinal container 100 of this invention is shown. Safety threaded child proof mechanism 260 includes male safety threads 262 in contact with female safety cap 264. Female safety cap 264 is situated on an interior of cylinder side 204 above bottom base 202. Male safety threads 262 are situated on the exterior of outer container 130 and is oppositely disposed from spacer 132 (FIG. 1). Clearly male safety thread 262 fit into female safety threads 264 and holds bottom cover 200 in position.

The safety factor comes standard safety threaded child proof mechanism 260 requires a pull away from outer container 130, then twisting. The pull away permits outer container ridges 266 on outer container 130 above male safety threads 262 to avoid contact with cap ridges 268. When such contact is avoided, removal of bottom cover 200 is possible. Clearly, safety threaded child proof mechanism 260 applies to top cover 150 also.

Figure 10:
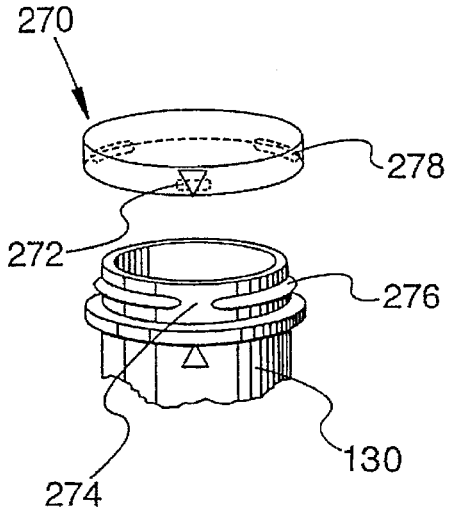
FIG. 10 depicts a side plan cross-sectional view of the alignment child proof mechanism 270 for either the top cover 150 or the bottom cover 200 of the medicinal container 100 of this invention.

In FIG. 10, a standard alignment mechanism 270 for the bottom cover 200 of the medicinal container 100 of this invention is shown. Alignment mechanism 270 includes male alignment member 272 aligned with female alignment member 274 for lifting off bottom cover 200. With male alignment member 272 aligned with female alignment member 274, bottom cover 200 or top cover 150 may be removed. With male alignment member 272 not aligned with female alignment member 274, various container protrusions 276 and cap protrusions 278 combine to prevent removal of bottom cover 200 (or top cover 150 if appropriate).

Figure 11:
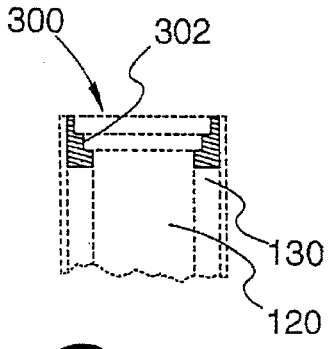
FIG. 11 depicts spacer 124 having a stepped cross-section 300.
Figure 12:
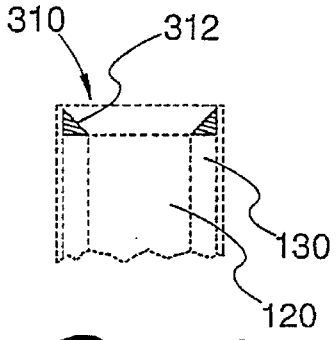
FIG. 12 depicts spacer 124 having a triangular cross-section 310.
Figure 13:
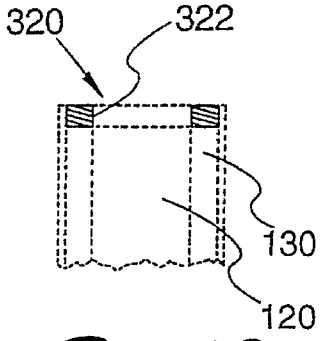
FIG. 13 depicts spacer 124 having a rectangular cross-section 320.

FIG. 11, FIG. 12 and FIG. 13 combine to show various models of spacer 124. Spacer 124 of FIG. 11, with stepped cross-section 300, is preferred. The stepped cross-section 300 shows spacer 124 with three steps 302 adjacent to inner container 120. Steps 302 provide for efficient pill dispensing.

While it is not desired to be bound by any particular theory, steps 302 are believed to create friction adjacent thereto, which provides single pill dispensing more efficiently. While at three steps 302 are preferred, two steps 302 are operable.

The triangular cross-section 310 of FIG. 12 provides a sloped surface 312 adjacent to inner container 120. The rectangular cross-section 320 of FIG. 13 provides a straight surface 322 adjacent to inner container 120.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A compartmented container for holding usable contents and information about the contents in proximity to the contents, the compartmented container comprising:

(a) an outer container having an inner container secured therein;

(b) a securing means mounting the inner container within the outer container;

(c) a first opening in the compartmented container;

(d) a second opening in the compartmented container;

(e) a first closure means releasably closing the first opening in the compartmented container;

(f) a second closure means releasably closing the second opening in the compartmented container;

(g) the first opening communicating with the inner container; and (h) the second opening communicating with the outer container.

2. The compartmented container of claim 1, further comprising:

(a) the outer container being substantially concentric with the inner container;

(b) the securing means being mounted adjacent to the first opening;

(c) the securing means providing a separation between the outer container and the inner container;

(d) the securing means providing a second compartment between the outer container and the inner container; and (e) the second closure means releasably closing the second compartment at the second opening.

3. The compartmented container of claim 2, further comprising:

(a) the first opening providing access to the inner container;

(b) the securing means preventing access to the outer container through the first opening; and (c) the inner container having an extension means which extends beyond the outer container at the second end.

4. The compartmented container of claim 3, further comprising:

(a) the second closure means being a cylinder;

(b) the cylinder being closed on a first cylinder end;

(c) a fastening means being situated on a second cylinder end;

(d) the first cylinder end being oppositely disposed from the second cylinder end; and (e) the fastening means securing the second closure means to the outer container.

5. The compartmented container of claim 4, further comprising:

(a) the second closure means receiving the extension means;

(b) the extension means including an insertion means; and (b) the extension means including an insertion means.

6. The compartmented container of claim 5, further comprising:

(a) the extension means including an elongated slot in a bottom edge thereof;

(b) the extension means including a notch in the bottom edge thereof;

(c) the elongated slot assisting in an insertion of instructions into the second opening and thence the second compartment; and (d) the notch assisting in a removal of instructions from the second compartment and thence the second opening.

7. The compartmented container of claim 6, further comprising:

(a) the elongated slot having a linear shape; and (b) the notch having an arcuate shape.

8. The compartmented container of claim 7, further comprising:

(a) the elongated slot being oppositely disposed from the notch;

(b) the inner container and the outer container and the spacer being one-piece.

9. The compartmented container of claim 7, further comprising:

(a) the linear shape of the elongated slot being substantially rectangular;

(b) the elongated slot assisting in an insertion of instructions into the second opening; and (c) the notch assisting in a removal of instructions from the second opening.

10. The compartmented container of claim 9, further comprising:

(a) the securing means having an annular shape;

(b) the annular shape having a cross-section selected from the group consisting of a substantially rectangular shape, a substantially triangular shape, and a stepped shape;

(c) the annular shape having an outer side secured to the outer container; and (d) the annular shape having an inner side secured to the inner container.

11. The compartmented container of claim 10, further comprising:

(a) a first joining means releasably securing the first closure means to the first opening; and (b) a second joining means releasably securing the second closure means to the second opening.

12. The compartmented container of claim 11, further comprising:

(a) a first joining means being selected from the group consisting of a screw type, a bayonet type, a snap type, and a child proof type; and (b) the second joining being selected from the group consisting of a screw type, a bayonet type, a snap type, and a child proof type.

13. A compartmented container for holding usable contents and information about the contents in proximity to the contents, the compartmented container comprising:

(a) an outer container having an inner container secured therein;

(b) a securing means mounting the inner container within the outer container;

(c) a first opening in the compartmented container;

(d) a second opening in the compartmented container;

(e) a first closure means releasably closing the first opening in the compartmented container;

(f) a second closure means releasably closing the second opening in the compartmented container;

(g) the first opening communicating with the inner container;

(h) the second opening communicating with the outer container;

(i) the outer container being substantially concentric with the inner container;

(j) the securing means being mounted adjacent to the first opening;

(k) the securing means providing a separation between the outer container and the inner container;

(l) the securing means providing a second compartment between the outer container and the inner container;

(m) the second closure means releasably closing the second compartment at the second opening;

(n) the securing means having an annular shape;

(o) the annular shape having a cross-section with a stepped shape.

14. The compartmented container of claim 13, further comprising:

(a) the first opening providing access to the inner container;

(b) the securing means preventing access to the outer container through the first opening; and (c) the inner container having an extension means which extends beyond the outer container at the second end.

15. The compartmented container of claim 14, further comprising:

(a) the second closure means being a cylinder;

(b) the cylinder being closed on a first cylinder end;

(c) a fastening means being situated on a second cylinder end;

(d) the first cylinder end being oppositely disposed from the second cylinder end;

(e) the fastening means securing the second closure means to the outer container;

(f) the second closure means receiving the extension means;

(g) the extension means including an insertion means; and (h) the extension means including an insertion means.

16. The compartmented container of claim 15, further comprising:

(a) the extension means including an elongated slot in a bottom edge thereof;

(b) the extension means including a notch in the bottom edge thereof;

(c) the elongated slot assisting in an insertion of instructions into the second opening and thence the second compartment; and (d) the notch assisting in a removal of instructions from the second compartment and thence the second opening.

17. The compartmented container of claim 16, further comprising:

(a) the elongated slot having a linear shape; and (b) the notch having an arcuate shape.

18. The compartmented container of claim 17, further comprising the elongated slot being oppositely disposed from the notch.

19. A method for inserting a paper into a compartmented container comprising:

(a) providing the compartmented container with an outer substantially, cylindrical container having an inner substantially, cylindrical container substantially, concentrically secured therein with a receiving space therebetween;

(b) providing an extension means for the inner container beyond the outer container;

(c) providing the extension means with a paper receiving means and a paper removing means;

(d) inserting an edge of a paper in the paper receiving means;

(e) wrapping the paper around the extension means;

(f) removing the paper from the paper receiving means; and (g) inserting the paper into the receiving space.

20. The method of claim 19 further comprising:

(a) the paper receiving means being a slot;

(b) the paper removing means being a notch, the notch providing a gripping of the paper for removal purposes;

(c) the slot and the notch being diametrically opposed; and (d) the compartmented container being one piece with a top cover and a bottom cover.

* * * * *